US010687606B1

(12) United States Patent
Nicks, III et al.

(10) Patent No.: US 10,687,606 B1
(45) Date of Patent: Jun. 23, 2020

(54) MULTI-PURPOSE SEAT ORGANIZER

(71) Applicants: Edward L. Nicks, III, Chapin, SC (US); James W. Gable, Jr., Irmo, SC (US); Justin J. Gable, Chapin, SC (US)

(72) Inventors: Edward L. Nicks, III, Chapin, SC (US); James W. Gable, Jr., Irmo, SC (US); Justin J. Gable, Chapin, SC (US)

( * ) Notice: Subject to any disclaimer, the term of this patent is extended or adjusted under 35 U.S.C. 154(b) by 0 days.

(21) Appl. No.: 16/208,312

(22) Filed: Dec. 3, 2018

(51) Int. Cl.

| | |
|---|---|
| ***F25D 3/08*** | (2006.01) |
| ***A45C 11/20*** | (2006.01) |
| ***A45F 3/02*** | (2006.01) |
| ***A45F 4/02*** | (2006.01) |
| ***A47C 13/00*** | (2006.01) |
| *B65D 43/16* | (2006.01) |
| *A45C 13/02* | (2006.01) |
| *A45C 5/03* | (2006.01) |
| *A45C 9/00* | (2006.01) |

(52) U.S. Cl.
CPC ..... *A45F 4/02* (2013.01); *A47C 13/00* (2013.01); *A45C 11/20* (2013.01); *A45C 2005/037* (2013.01); *A45C 2009/002* (2013.01); *A45C 2013/026* (2013.01); *A45F 3/02* (2013.01); *A45F 2004/026* (2013.01); *B65D 43/163* (2013.01); *F25D 3/08* (2013.01)

(58) Field of Classification Search
CPC ..... Y10S 220/914; A45C 11/20; F25D 3/08; A45F 3/02; A45F 2004/026
USPC ..... D7/605, 607; 62/457.7; 224/155, 578, 224/579, 607, 610, 611, 614, 616, 617, 224/618, 629
See application file for complete search history.

(56) References Cited

U.S. PATENT DOCUMENTS

| | | | | |
|---|---|---|---|---|
| 1,354,660 | A | | 10/1920 | Kanthack |
| 1,470,334 | A | | 10/1923 | Stensgaard et al. |
| 1,806,477 | A | | 5/1931 | Lloyd et al. |
| 2,825,208 | A | * | 3/1958 | Anderson ..... F25D 3/00 190/109 |
| 2,902,195 | A | | 9/1959 | Marshall |
| 2,954,893 | A | * | 10/1960 | Sayre ..... A47J 41/0088 206/561 |
| 3,549,064 | A | * | 12/1970 | Wilson ..... B25H 3/023 224/580 |
| D236,856 | S | * | 9/1975 | Miller ..... D7/605 |
| 3,910,470 | A | | 10/1975 | Swenson et al. |
| 3,980,216 | A | * | 9/1976 | Nye ..... A45C 11/20 224/629 |
| 3,997,092 | A | | 12/1976 | Pogwizd |

(Continued)

*Primary Examiner* — Justin M Larson
(74) *Attorney, Agent, or Firm* — Jeffrey C. Watson; Mathew L. Grell; Grell & Watson Patent Attorneys LLC

(57) ABSTRACT

A multi-purpose seat organizer includes a sealed container body having a front side, a back side, a left side, a right side, a bottom and a hinged lid. The front side has a concave configuration. The hinged lid includes a back edge hingedly fixed to the back side for accessing an interior of the sealed container body. The hinged lid includes a concave front edge configured to match the concave configuration of the front side. The concave configuration of the front side and the concave front edge of the hinged lid are configured to wrap around a body of a user while being carried thereby positioning a center of gravity of the multi-purpose seat organizer closer to the user while being carried.

11 Claims, 9 Drawing Sheets

(56) References Cited

U.S. PATENT DOCUMENTS 4,054,005 A 10/1977 Lightfoot
4,499,998 A * 2/1985 Carlson ..... A45C 11/20 206/541
4,830,154 A * 5/1989 Gerch ..... A45C 3/00 190/103
5,076,405 A * 12/1991 Modica ..... A45C 3/10 190/1
D333,775 S * 3/1993 Krape ..... D8/331
5,400,610 A * 3/1995 Macedo ..... A45C 11/20 116/216
5,407,218 A * 4/1995 Jackson ..... A45C 5/14 280/30
5,421,172 A * 6/1995 Jones ..... F25D 3/08 62/457.5
5,462,213 A * 10/1995 Watt ..... A45C 15/00 220/629
5,471,779 A * 12/1995 Downey ..... A01K 97/22 206/315.11
D371,942 S * 7/1996 Lippincott ..... D7/607
D380,945 S * 7/1997 Alegria ..... D7/709
D389,704 S 1/1998 Yousko et al.
D406,013 S 2/1999 Yousko et al.
5,944,241 A * 8/1999 Globig ..... A01M 31/02 182/187
D420,795 S 2/2000 Sanders, Jr. et al.
D422,453 S * 4/2000 Klein ..... D7/605
6,105,844 A * 8/2000 Walters ..... A45C 11/20 206/541
6,116,045 A * 9/2000 Hodosh ..... A45C 11/20 62/457.4
6,220,493 B1 * 4/2001 Iijima ..... A45F 3/00 224/153
6,237,776 B1 * 5/2001 Mogil ..... A45C 3/00 150/106
6,279,707 B1 8/2001 Godshaw et al.
6,347,706 B1 * 2/2002 D'Ambrosio ..... A45C 11/20 206/232
6,390,345 B1 * 5/2002 Brown ..... A45C 3/00 190/110
6,460,746 B1 * 10/2002 Amram ..... A45F 3/047 224/579
6,474,097 B2 * 11/2002 Treppedi ..... A45C 11/20 280/30
D468,533 S * 1/2003 MacRae ..... D3/283
6,513,661 B1 * 2/2003 Mogil ..... A45C 3/00 150/106
6,966,450 B2 * 11/2005 Askew ..... B65D 25/06 220/529
7,004,323 B1 * 2/2006 Symonds ..... A45C 11/20 206/542
D516,869 S * 3/2006 Beal ..... D21/423
7,032,753 B2 * 4/2006 Purvis ..... B65D 81/3813 206/459.5
7,040,115 B1 * 5/2006 Lopez ..... F25D 3/08 62/371
7,044,424 B2 * 5/2006 Robertson ..... A47F 3/0439 206/561
7,140,507 B2 * 11/2006 Maldonado ..... A45C 11/20 220/592.2
7,178,673 B1 * 2/2007 Miller ..... A45C 11/20 206/545
D547,129 S * 7/2007 Jones ..... D7/605
7,389,608 B1 * 6/2008 MacKay ..... A01K 97/05 206/315.11
D573,344 S 7/2008 Yang
7,415,794 B1 * 8/2008 Thompson ..... A01K 97/22 206/315.11
7,475,889 B2 * 1/2009 Marmah ..... A47C 1/14 280/30
D608,601 S * 1/2010 Whitlock ..... D7/607
8,573,002 B2 11/2013 Ledoux et al.
8,640,937 B2 * 2/2014 Pruchnicki ..... A45C 11/20 224/612
D712,723 S * 9/2014 Seiders ..... B65D 81/3816 D8/343
D714,125 S * 9/2014 Seiders ..... B65D 81/3816 D8/331
8,899,071 B2 * 12/2014 Mogil ..... A45C 11/20 62/371
D740,028 S * 10/2015 Ortego ..... D3/300
9,187,232 B2 * 11/2015 Seiders ..... B65D 81/3816
9,205,962 B2 * 12/2015 Holderby ..... B65D 51/245
D747,950 S * 1/2016 Jacobsen ..... D8/331
D748,452 S * 2/2016 Jacobsen ..... D8/331
9,282,797 B1 * 3/2016 Soto ..... A45C 11/20
9,310,118 B2 * 4/2016 Zavitsanos ..... A45C 11/20
9,389,010 B1 * 7/2016 Booker, Sr. ..... B62B 3/02
D762,384 S * 8/2016 Boroski ..... D3/283
9,433,200 B2 * 9/2016 Norman ..... A01K 97/08
9,462,874 B1 * 10/2016 Samuel ..... A45C 13/02
9,500,400 B2 * 11/2016 Smith ..... F25D 3/08
D797,518 S * 9/2017 Pavia, III ..... D7/605
9,834,342 B2 * 12/2017 Seiders ..... B65D 81/3816
9,839,281 B2 * 12/2017 Pompliano ..... A45F 4/02
10,046,900 B2 * 8/2018 Seiders ..... B65D 81/3816
10,098,427 B2 * 10/2018 Mogil ..... A45C 3/001
10,138,047 B2 * 11/2018 Seiders ..... B65D 25/2808
D845,717 S * 4/2019 Cavenagh ..... D7/605
D860,789 S * 9/2019 Rayeski ..... D9/456
10,401,075 B2 * 9/2019 Bond ..... B65D 25/04
10,429,116 B2 * 10/2019 Huish ..... A45C 13/262
10,486,726 B1 * 11/2019 Logan ..... B62B 5/0069
2004/0035143 A1 * 2/2004 Mogil ..... A45C 7/0077 62/457.2
2004/0065708 A1 * 4/2004 Amram ..... A45F 3/047 224/579
2004/0144821 A1 7/2004 Gelphman
2004/0238543 A1 * 12/2004 Askew ..... B65D 25/06 220/529
2005/0279123 A1 * 12/2005 Maldonado ..... A45C 5/02 62/457.7
2006/0144077 A1 * 7/2006 Morris ..... F25D 3/08 62/459
2007/0205234 A1 * 9/2007 Lessmann ..... A45F 3/04 224/155
2010/0126196 A1 * 5/2010 McCance ..... A45C 11/20 62/264
2014/0138384 A1 * 5/2014 O'Brien ..... A45C 13/001 220/378
2015/0291320 A1 * 10/2015 Ortego ..... A45C 11/20 383/117
2016/0161177 A1 * 6/2016 Bond ..... A45C 11/20 220/735
2016/0244209 A1 * 8/2016 Hain ..... A45C 7/0045
2017/0023289 A1 * 1/2017 Anderson ..... F25D 3/08
2017/0159989 A1 * 6/2017 Bodnar ..... F25D 3/06
2017/0259956 A1 * 9/2017 Hori ..... A45C 7/0045
2018/0080700 A1 * 3/2018 Cooper ..... F25D 3/08
2018/0141718 A1 * 5/2018 Ahlstrom ..... A45F 3/46
2018/0186547 A1 * 7/2018 Morine ..... A47G 23/02
2018/0290814 A1 * 10/2018 Smith ..... B65D 81/3816
2018/0312294 A1 * 11/2018 Wang ..... A47J 41/00
2018/0335241 A1 * 11/2018 Li ..... F25D 3/08
2019/0000233 A1 * 1/2019 Holland ..... G09F 1/00
2019/0161240 A1 * 5/2019 Ahlstrom ..... A45F 3/46
2020/0045959 A1 * 2/2020 Hoffmann ..... F25D 3/08

* cited by examiner

MULTI-PURPOSE SEAT ORGANIZER

FIELD OF THE DISCLOSURE

The present disclosure is related to organizers, containers, coolers, seats, the like, and combinations thereof. More specifically, the present disclosure is directed toward a multi-purpose seat organizer.

BACKGROUND

Generally speaking, a variety of plastic and other material seats, organizers, containers, the like, are widely available on the market for various purposes and uses, like outdoors, hunting, fishing, pool, beach, etc. Traditionally, these devices are no more than simple seats, organizers or containers with single uses. These traditional seats, organizers, containers, however, are typically large and unwieldy when carried or transported together, not to mention aesthetically and ergonomically unrefined. These devices are therefore ill-suited for persons wishing to bring a single device for providing a seat, organizer, container and/or cooler all in one device that is easy to transport. A need therefore clearly exists for a single device that can be used as a seat, organizer, container or cooler that is multi-functional and easy to transport to and from various activities.

The instant disclosure is designed to address at least certain aspects of the problems or needs discussed above by providing a multi-purpose seat organizer.

SUMMARY

Accordingly, in one aspect, the present disclosure embraces a multi-purpose seat organizer. The multi-purpose seat organizer generally may include a sealed container body having a front side, a back side, a left side, a right side, a bottom and a hinged lid. The front side may have a concave configuration. The hinged lid may include a back edge hingedly fixed to the back side for accessing an interior of the sealed container body. The hinged lid may include a concave front edge configured to match the concave configuration of the front side. The concave configuration of the front side and the concave front edge of the hinged lid may be configured to wrap around a body of a user while being carried thereby positioning a center of gravity of the multi-purpose seat organizer closer to the user while being carried.

One feature of the disclosed multi-purpose seat organizer may be that the concave configuration of the front side and the concave front edge of the hinged lid positioning the center of gravity of the multi-purpose seat organizer closer to the user while being carried may be configured to limit the amount of torque or linear forces placed on the body of the user.

In select embodiments of the disclosed multi-purpose seat organizer, a shoulder strap may be cross-connected to aid in positioning the center of gravity of the multi-purpose seat organizer closer to the user while being carried and to limit the amount of torque or linear forces placed on the body of the user. In these embodiments, four strap connection points may be included approximate the hinged lid. These four strap connection points may include: a first strap connection point at a first corner of the front side and the left side; a second strap connection point at a second corner of the front side and the right side; a third strap connection point at a third corner of the back side and the left side; and a fourth strap connection point at a fourth corner of the back side and the right side. Accordingly, the shoulder strap may be cross-connected between either: the first strap connection point and the fourth strap connection point; or the second strap connection point and the third strap connection point. In select embodiments, each of the four strap connection points may include a pyramid shaped protrusion with a cutout at a peak of the pyramid shaped protrusion. A rod may be positioned through the cutout of the protrusion. The shoulder strap may include removable clasps at each end configured to be inserted in the cutout of the protrusion and attached to the rod.

Another feature of the disclosed multi-purpose seat organizer may be that the concave configuration of the front side and the concave front edge of the hinged lid may also be configured to allow the user to bring their legs and feet more underneath them while sitting on the hinged lid. In select embodiments of the multi-purpose seat organizer, the hinged lid may include a cushion configured to be removably attached to the hinged lid, like via snaps, other connection devices, or the like. The cushion may be shaped to conform to the hinged lid with the concave front edge. In select embodiments, the cushion may have a thickness of 2 inches or approximately 2 inches, wherein the overall height of the multi-purpose seat organizer with the cushion may be between 17 inches and 19 inches thereby conforming to disability guidelines, like within the height guidance of the American's with Disabilities Act.

Another feature of the disclosed multi-purpose seat organizer may be that the interior of the sealed container body may have a modular interior design. The modular interior design may include at least one channel configured to receive a divider. When the divider is inserted into the at least one channel, the divider may divide the interior into multiple compartments. In select embodiments, the modular interior design of the interior of the sealed container body may include a length channel extending from an interior left wall through a bottom surface to an interior right wall. The length channel may be configured to receive a length divider across a length of the interior of the sealed container body. When the length divider is inserted into the length channel, the length divider may divide the interior into two width-wise compartments along a width of the multi-purpose seat organizer. In select other embodiments, the modular interior design of the interior of the sealed container body may include at least a first width channel and a second width channel. The first width channel may extend from an interior front wall through a bottom surface to an interior rear wall. The first width channel may be configured to receive a first width divider across a width of the interior of the sealed container body. The second width channel may extend from the interior front wall through the bottom surface to the interior rear wall. The second width channel may be configured to receive a second width divider across the width of the interior of the sealed container body. When the first width divider is inserted into the first width channel and the second width divider is inserted into the second width channel, the first width divider and the second width divider may divide the interior into three length-wise compartments along a length of the multi-purpose seat organizer. In other select embodiments, the modular interior design of the interior of the sealed container body may include or consist of the length channel, the first width channel and the second width channel, as described earlier. Whereby, when the length divider is inserted into the length channel, the length divider divides the interior into two width-wise compartments along the width of the multi-purpose seat organizer; or when the first width divider is inserted into the first width channel and the second width divider is inserted into the second width channel, the first width divider and the second width divider divides the interior into three length-wise compartments along the length of the multi-purpose seat organizer. Each of the at least one channels of the modular interior design may be molded or formed into interior walls to allow for use of the divider or dividers. The divider may be configured to seal to the channel formed into the interior walls.

In select embodiments of the disclosed multi-purpose seat organizer, a trey may be included. The trey may be configured and shaped to fit in the interior of the sealed container body including the concave front side. In select embodiments, the divider or dividers may include a reduced height configured to allow the trey to rest on the divider in the interior of the sealed container body at an elevated position approximate the hinged lid. In select embodiments, a lip, tabs, or protrusions may be included in the interior for supporting the trey in the interior of the sealed body container.

In select embodiments of the disclosed multi-purpose seat organizer, a top rim of the sealed container body may include a gasket configured for sealing to the hinged lid. The hinged lid may include rubber pull down latches with T-handles on both side of the hinged lid. The rubber pull down latches with T-handles may be configured to engage latch connection members protruding from the left side and the right side of the sealed container body. When the hinged lid is closed on the sealed container body and the rubber pulldown latches with T-handles are engaged in the latch connection members, the hinged lid may be sealed to the top rim of the sealed container body via the gasket.

Another feature of the disclosed multi-purpose seat organizer may be the inclusion of a waterproof storage pouch on and underside of the hinged lid.

Another feature of the disclosed multi-purpose seat organizer may be the inclusion of a drain plug. The drain plug may be in one of the sides near the bottom. The interior of the sealed container body may include a sloped bottom portion configured to allow for washout using the drain plug.

Another feature of the disclosed multi-purpose seat organizer may be the inclusion of at least one accessory connection unit. The accessory connection unit or units may be configured for connecting accessories to the multi-purpose seat organizer. In select embodiments, the at least one accessory connection unit may include: a first handle connection unit on the right side; a second handle connection unit on the left side; four horizontal connection units on the back side; and four vertical connection units on the back side. Each of the accessory connection units may be molded protrusions extending out from the sealed container body with attachment holes or slots therethrough.

Another feature of the disclosed multi-purpose seat organizer may be the inclusion of non-skid rubber feet. The non-skid rubber feet may be on the bottom of the sealed container body. The non-skid rubber feet may be positioned approximate the corners of the bottom of the sealed container body.

Another feature of the disclosed multi-purpose seat organizer may be that the sealed container body may include insulated walls. The insulated walls of the sealed container body may be constructed out of non-porous plastic. The insulated walls may be configured to maintain temperatures inside the multi-purpose seat organizer and to reduce condensation on the exterior of the multi-purpose seat organizer.

In another aspect, the instant disclosure embraces a multi-purpose seat organizer that generally includes a sealed container body having a front side, a back side, a left side, a right side, a bottom and a hinged lid. The front side may have a concave configuration. The hinged lid may include a back edge hingedly fixed to the back side for accessing an interior of the sealed container body. The hinged lid may include a concave front edge configured to match the concave configuration of the front side. The concave configuration of the front side and the concave front edge of the hinged lid may be configured to wrap around a body of a user while being carried thereby positioning a center of gravity of the multi-purpose seat organizer closer to the user while being carried. A shoulder strap may be included in this aspect of the multi-purpose seat organizer. The shoulder strap may be cross-connected to aid in positioning the center of gravity of the multi-purpose seat organizer closer to the user while being carried and to limit the amount of torque or linear forces placed on the body of the user. Four strap connection points may be approximate the hinged lid including: a first strap connection point at a first corner of the front side and the left side; a second strap connection point at a second corner of the front side and the right side; a third strap connection point at a third corner of the back side and the left side; and a fourth strap connection point at a fourth corner of the back side and the right side. Thus, the shoulder strap may be cross-connected between either: the first strap connection point and the fourth strap connection point; or the second strap connection point and the third strap connection point.

In another aspect, the instant disclosure embraces a multi-purpose seat organizer that generally includes a sealed container body having a front side, a back side, a left side, a right side, a bottom and a hinged lid. The front side may have a concave configuration. The hinged lid may include a back edge hingedly fixed to the back side for accessing an interior of the sealed container body. The hinged lid may include a concave front edge configured to match the concave configuration of the front side. The concave configuration of the front side and the concave front edge of the hinged lid may be configured to wrap around a body of a user while being carried thereby positioning a center of gravity of the multi-purpose seat organizer closer to the user while being carried. In this aspect, the interior of the sealed container body may have a modular interior design. The modular interior design may include at least one channel configured to receive a divider. The divider may be configured to seal to the channel formed into the interior walls. When the divider is inserted into the at least one channel, the divider may divide the interior into multiple compartments. The at least one channel of the modular interior design may be molded into interior walls to allow for use of the divider.

In select embodiments of this aspect of the multi-purpose seat organizer, the modular interior design of the sealed container body may include or consist of the length channel, the first width channel and the second width channel, as described earlier. Whereby, when the length divider is inserted into the length channel, the length divider divides the interior into two width-wise compartments along the width of the multi-purpose seat organizer; or when the first width divider is inserted into the first width channel and the second width divider is inserted into the second width channel, the first width divider and the second width divider divides the interior into three length-wise compartments along the length of the multi-purpose seat organizer.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
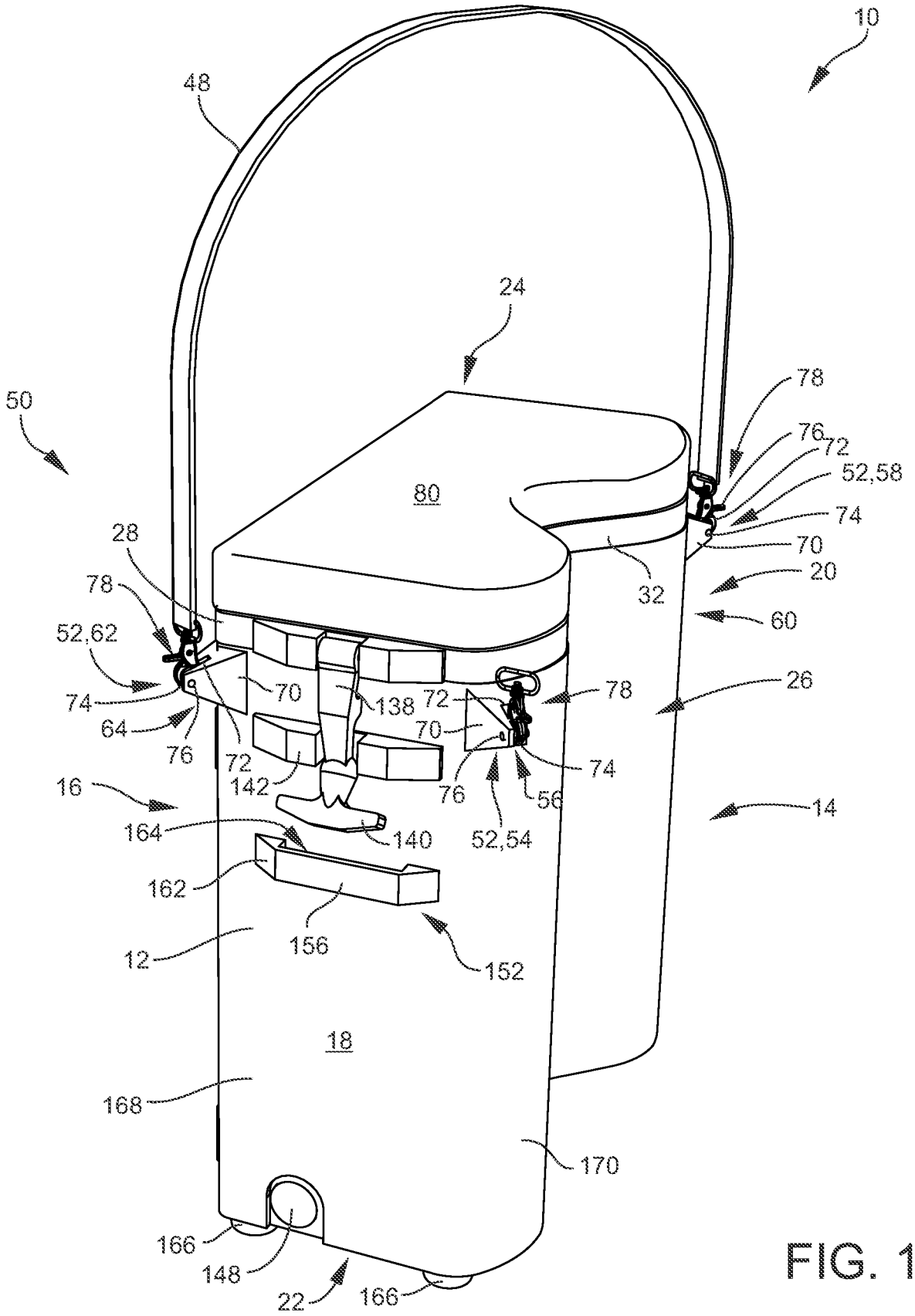
FIG. 1 is a front side perspective view of the multi-purpose seat organizer according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-9, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-9, in a possibly preferred embodiment, the present disclosure overcomes the above-mentioned disadvantages and meets the recognized need for such an apparatus or method by providing of multi-purpose seat organizer 10. Multi-purpose seat organizer 10 generally may include sealed container body 12. Sealed container body 12 may provide the overall shape and design of multi-purpose seat organizer 10 and may provide the structure for providing the functions of a seat, organizer, cooler etc. Sealed container body 12 may have front side 14, back side 16, left side 18, right side 20, bottom 22, and hinged lid 24. Front side 14 may have concave configuration 26. Hinged lid 24 may include back edge 28 hingedly fixed to back side 16 for accessing interior 30 of sealed container body 12. Hinged lid 24 may include a standard container or cooler lid hinge configured to rotate 90 degrees open and stop, as shown in FIGS. 5-8. Hinged lid 24 may include concave front edge 32 configured to match concave configuration 26 of front side 14.

Figure 3:
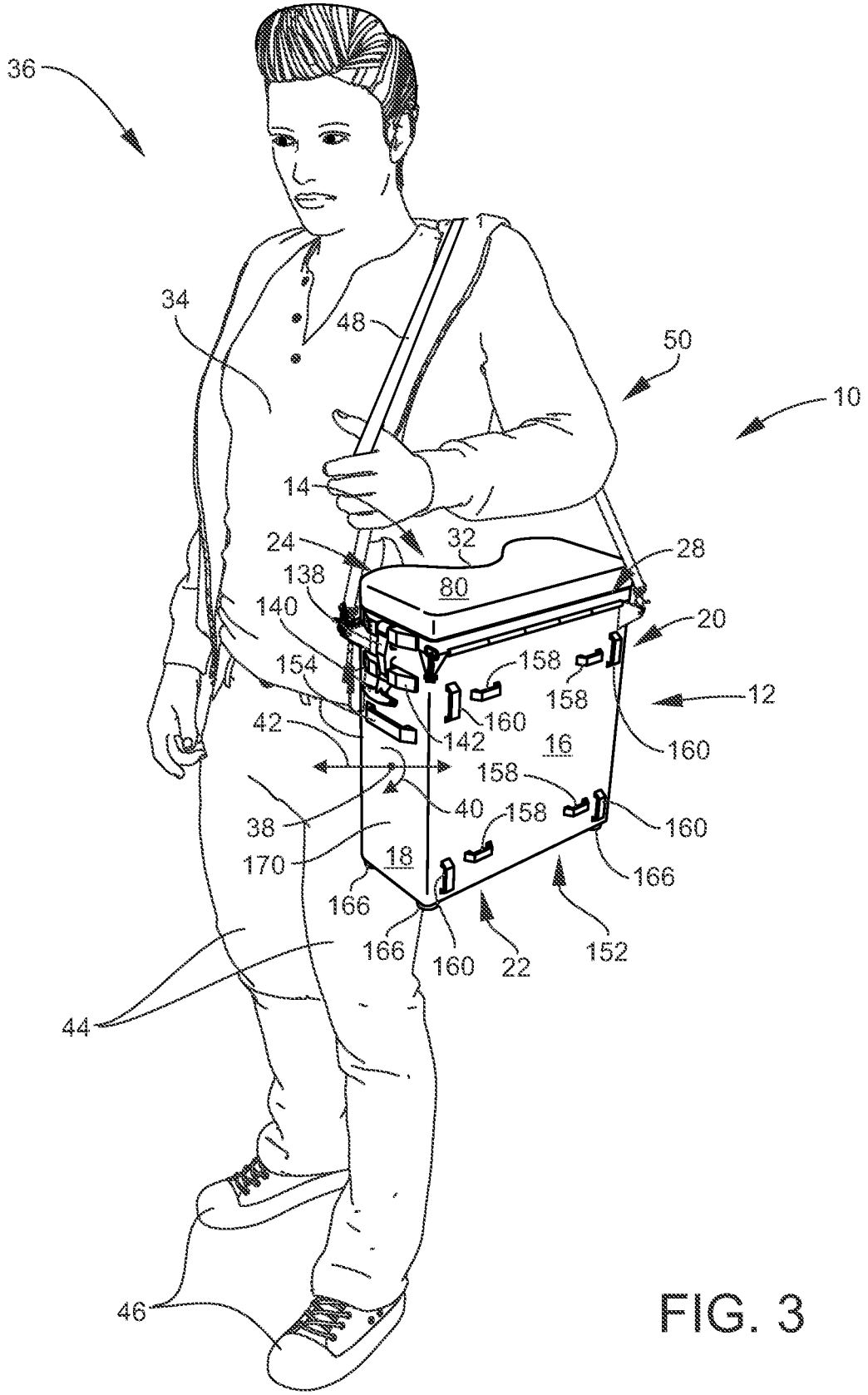
FIG. 3 is an environmental perspective view of the multi-purpose seat organizer of FIG. 1 being carried by a user with the center of gravity of the multi-purpose seat organizer positioned close to the user's body via the concave configuration of the front side thereby limiting torque and linear forces.

Referring now specifically to FIG. 3, concave configuration 26 of front side 14 and concave front edge 32 of hinged lid 24 may be configured to wrap around body 34 of user 36 while being carried thereby positioning center of gravity 38 of multi-purpose seat organizer 10 closer to user 36 while being carried. As such, concave configuration 26 of front side 14 and concave front edge 32 of hinged lid 24 positioning center of gravity 38 of multi-purpose seat organizer 10 closer to user 36 while being carried may be configured to limit the amount of torque 40 and/or linear forces 42 placed on body 34 of user 36. As shown in FIG. 3, when user 36 carries multi-purpose seat organizer 10 on a shoulder, concave configuration 26 of front side 14 and concave front edge 32 of hinged lid 24 allows center of gravity 38 to be positioned very close to body 34 of user 36 where center of gravity 38 is positioned directly below, or almost directly below, the user's shoulders where shoulder strap 48 is positioned. As such, the amount of torque 40 and/or linear forces 42 asserted on the body 34 of user is illuminated (if directly below the shoulder) or reduced from center of gravity positions that are farther away from the body. As such, the amount of force applied on the shoulder and or against the user's body may be reduced with concave configuration 26 of multi-purpose seat organizer 10.

In addition, as shown in the Figures, shoulder strap 48 may be cross-connected 50 between opposing corners of sealed container body 12 to aid in positioning center of gravity 38 of multi-purpose seat organizer 10 closer to the user 36 while being carried and to limit the amount of torque 40 and/or linear forces 42 placed on body 34 of user 36. In these embodiments, four strap connection points 52 may be included approximate hinged lid 24. These four strap connection points 52 may include: first strap connection point 54 at first corner 56 of front side 14 and left side 18; second strap connection point 58 at second corner 60 of front side 14 and right side 20; third strap connection point 62 at third corner 64 of back side 16 and left side 18; and fourth strap connection point 66 at fourth corner 68 of back side 16 and right side 20. Accordingly, shoulder strap 48 may be cross-connected 50 between either: first strap connection point 54 and fourth strap connection point 66; or second strap connection point 58 and third strap connection point 62 (as shown in the Figures). The four strap connection points 52 may be any design or shape configured for holding and supporting shoulder strap 48 while carrying multi-purpose seat container 10. In select embodiments, each of four strap connection points 52 may include pyramid shaped protrusion 70 with cutout 72 at peak 74 of pyramid shaped protrusion 70. Rod 76 may be positioned through cutout 72 of pyramid shaped protrusion 70. Shoulder strap 48 may include removable clasps 78 at each end configured to be inserted in cutout 72 of pyramid shaped protrusion 70 and attached to rod 76. As such, cutout 72 of pyramid shaped protrusion 70 may be sized and shaped to receive removable clasps 78 of should strap 48.

Figure 2:
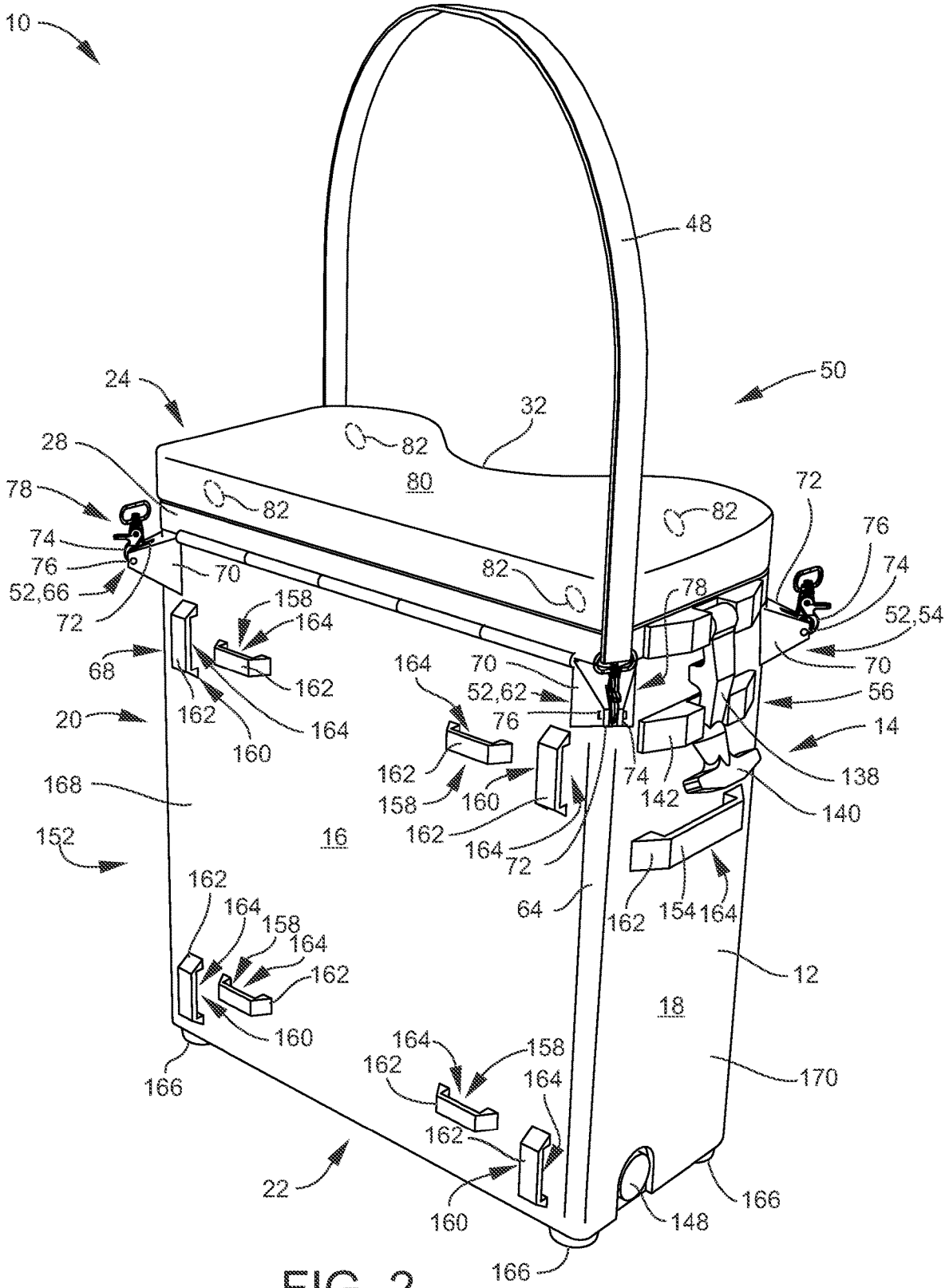
FIG. 2 is a back side perspective view of the multi-purpose seat organizer of FIG. 1.
Figure 4:
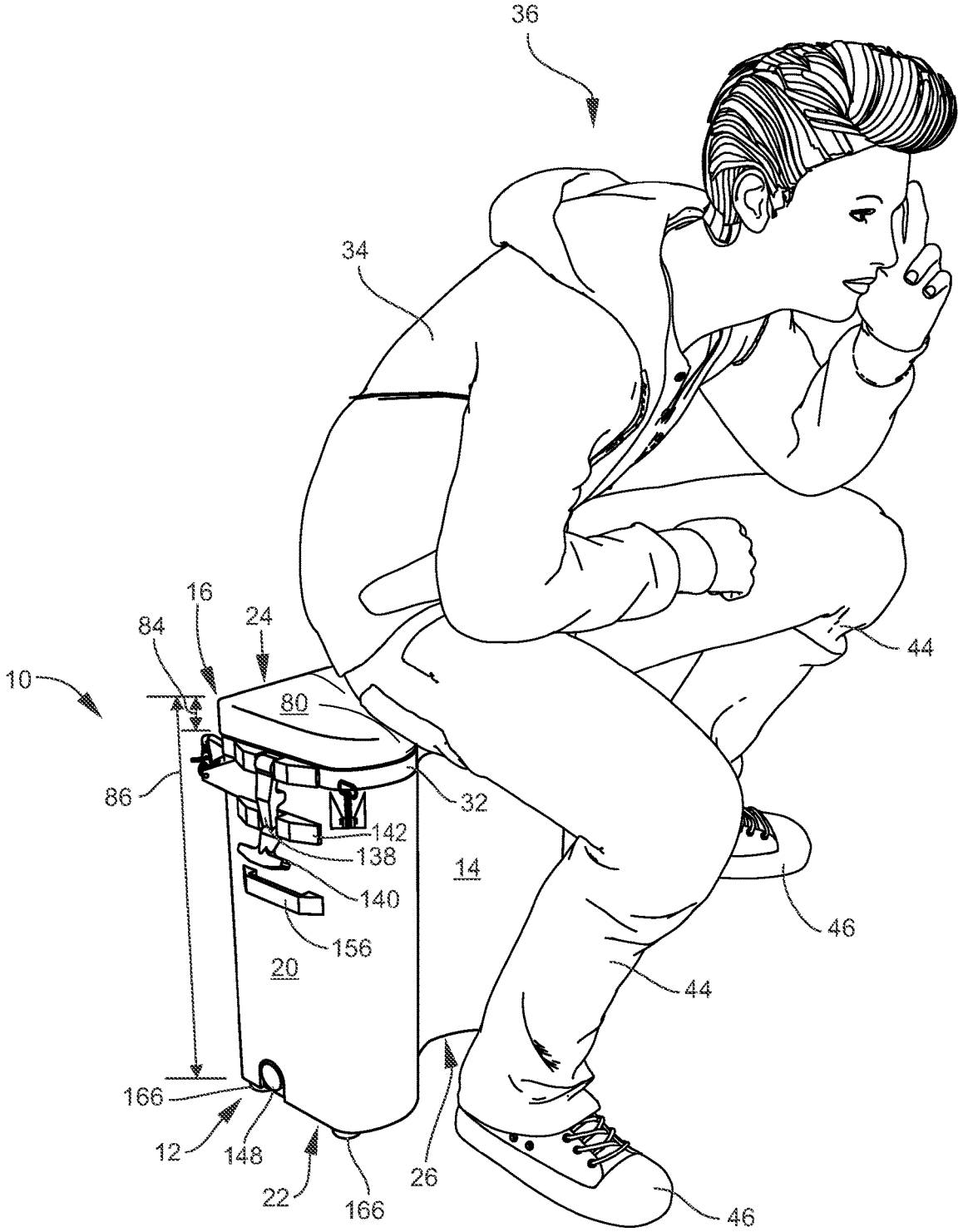
FIG. 4 is another environmental perspective view of the multi-purpose seat organizer of FIG. 1 being sat on by the user with the user's legs and feet positioned underneath the body of the user.

Referring now specifically to FIG. 4, another feature of multi-purpose seat organizer 10 may be its use as a seat. When used as a seat, concave configuration 26 of front side 14 and concave front edge 32 of hinged lid 24 may also be configured to allow user 36 to bring their legs 44 and feet 46 more underneath them while sitting on hinged lid 24. In select embodiments of multi-purpose seat organizer 10, hinged lid 24 may include cushion 80 configured to be removably attached to hinged lid 24. Cushion 80 may be removably attached to hinged lid 24 by any means. As an example, and clearly not limited thereto, in select embodiments, cushion 80 may be removably attached to hinged lid 24 via snaps 82, like as shown in FIG. 2. Cushion 80 may be shaped to conform to hinged lid 24 with concave front edge 32. In select embodiments, cushion 80 may have thickness 84 of 2 inches or approximately 2 inches (as shown in FIG. 4). Wherein, overall height 86 (also shown in FIG. 4) of multi-purpose seat organizer 10 with cushion 80 may be between 17 inches and 19 inches thereby conforming to disability guidelines, like within the height guidance of the American's with Disabilities Act.

Referring now to FIGS. 5-8, another feature of multi-purpose seat organizer 10 may be that interior 30 of sealed container body 12 may have modular interior design 88. Modular interior design 88 may be a means and devices for separating interior 30 of sealed container body 12 into multiple compartments 94. These multiple compartments 94 may include various sizes and shapes of compartments and may be changed based on the use and desires of the user. As such, modular interior design 88 may include at least one channel 90 positioned on, cut out, or molded into interior walls 96, configured to receive divider 92. When divider 92 is inserted into the at least one channel 90, divider 92 may divide interior 30 into multiple compartments 94.

Figure 6:
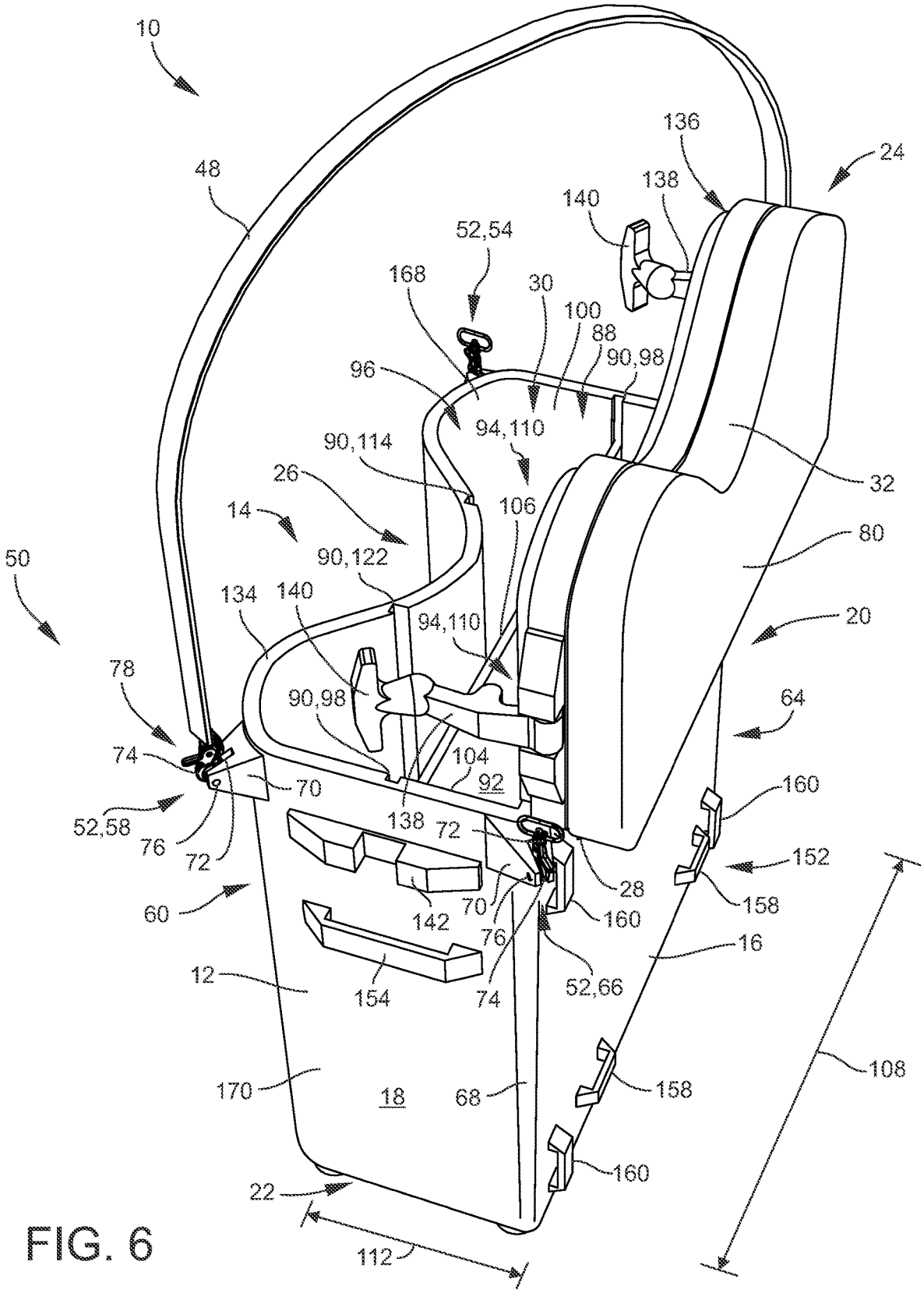
FIG. 6 is a side perspective view of the multi-purpose seat organizer of FIG. 1 with the hinged lid open showing the interior with the modular design having the length divider inserted in the length channel thereby creating 2 width-wise compartments.

Referring now specifically to FIG. 6, in select embodiments, modular interior design 88 of interior 30 of sealed container body 12 may include length channel 98 extending from interior left wall 100 through bottom surface 102 to interior right wall 104. Length channel 98 may be configured to receive length divider 106 across length 108 of interior 30 of sealed container body 12. As a result, when length divider 106 is inserted into length channel 98, length divider 106 may divide interior 30 into two width-wise compartments 110 along width 112 of multi-purpose seat organizer 10.

Figure 5:
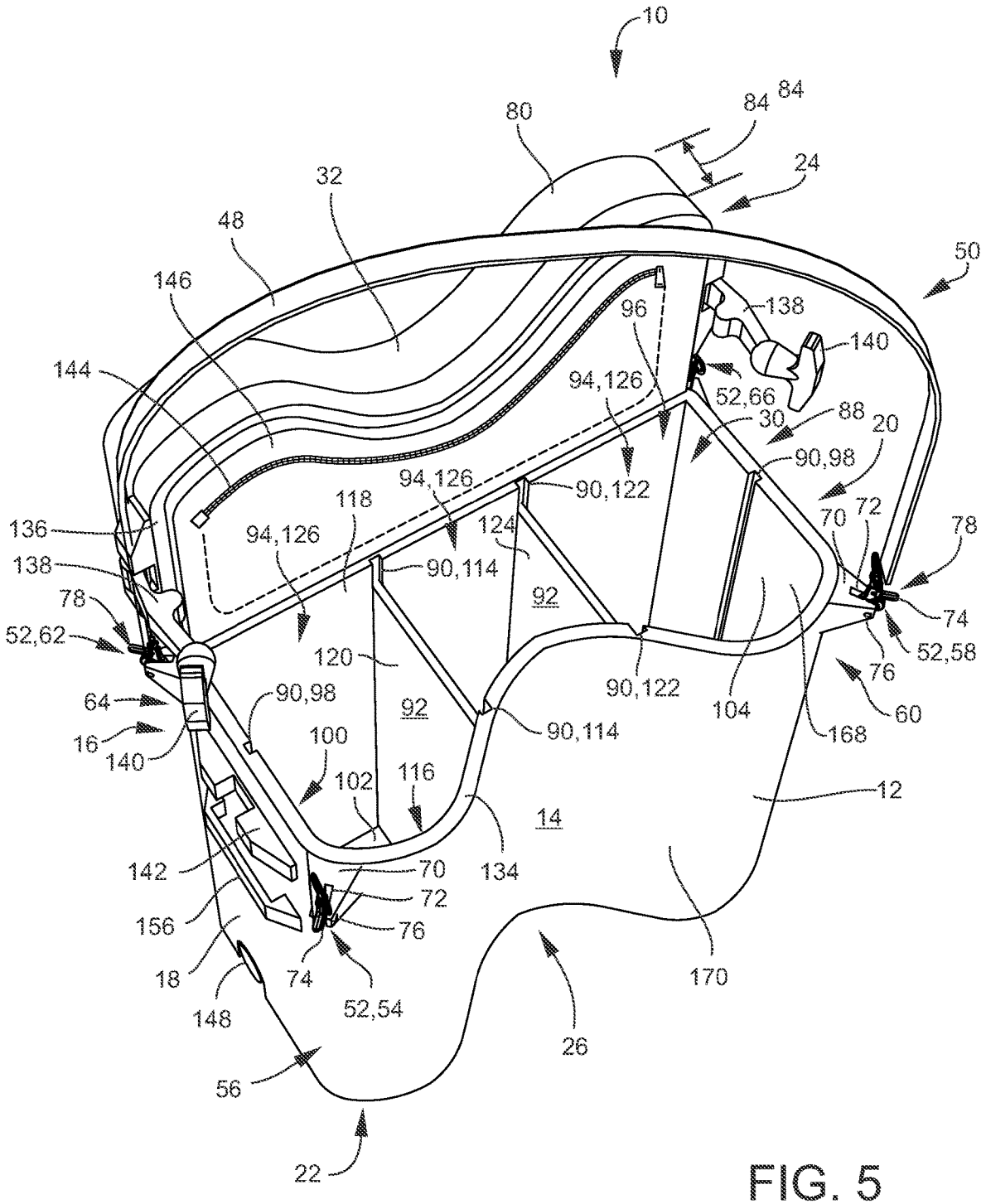
FIG. 5 is a top perspective view of the multi-purpose seat organizer of FIG. 1 with the hinged lid open showing the interior with the modular design having the first width divider and the second width divider in the first width channel and the second width channel, respectively, thereby creating 3 length-wise compartments.

Referring now to FIG. 5, in select other embodiments, modular interior design 88 of interior 30 of sealed container body 12 may include at least first width channel 114 and second width channel 122. First width channel 114 may extend from interior front wall 116 through bottom surface 102 to interior rear wall 118. First width channel 114 may be configured to receive first width divider 120 across width 112 of interior 130 of sealed container body 12. Second width channel 122 may extend from interior front wall 116 through bottom surface 102 to interior rear wall 118. Second width channel 122 may be configured to receive second width divider 124 across width 112 of interior 30 of sealed container body 12. As a result, when first width divider 120 is inserted into first width channel 114 and second width divider 124 is inserted into second width channel 122, first width divider 120 and second width divider 124 may divide interior 30 into three length-wise compartments 126 along length 108 of multi-purpose seat organizer 10.

As shown in the Figures, in select embodiments, modular interior design 88 of interior 30 of sealed container body 12 may include or consist of length channel 98, first width channel 114 and second width channel 122, as described above. Whereby, when width-wise compartments 110 are desired, length divider 106 may be inserted into length channel 98. Or, when length-wise compartments 126 are desired, first width divider 120 and/or second width divider 124 may be inserted into first and/or second width channels 114 and/or 122, respectively. In select embodiments, as shown in the Figures, each of the at least one channels 90 of modular interior design 88 may be molded or formed into interior walls 96 to allow for use of the divider 92 or dividers 92. The divider 92 or dividers 92 may be configured to seal to the channel formed into the interior walls 96, thereby creating separate sealed compartments 94 within interior 30 of multi-purpose seat organizer 10. As such, divider 92 or dividers 92 may be configured to create a water resistant seal to channel 90 or channels 90 thereby creating multiple compartments 94 that are sealed from one another where liquid or water can not move between the multiple compartments 94 inside interior 30 of sealed container body 12.

Figure 7:
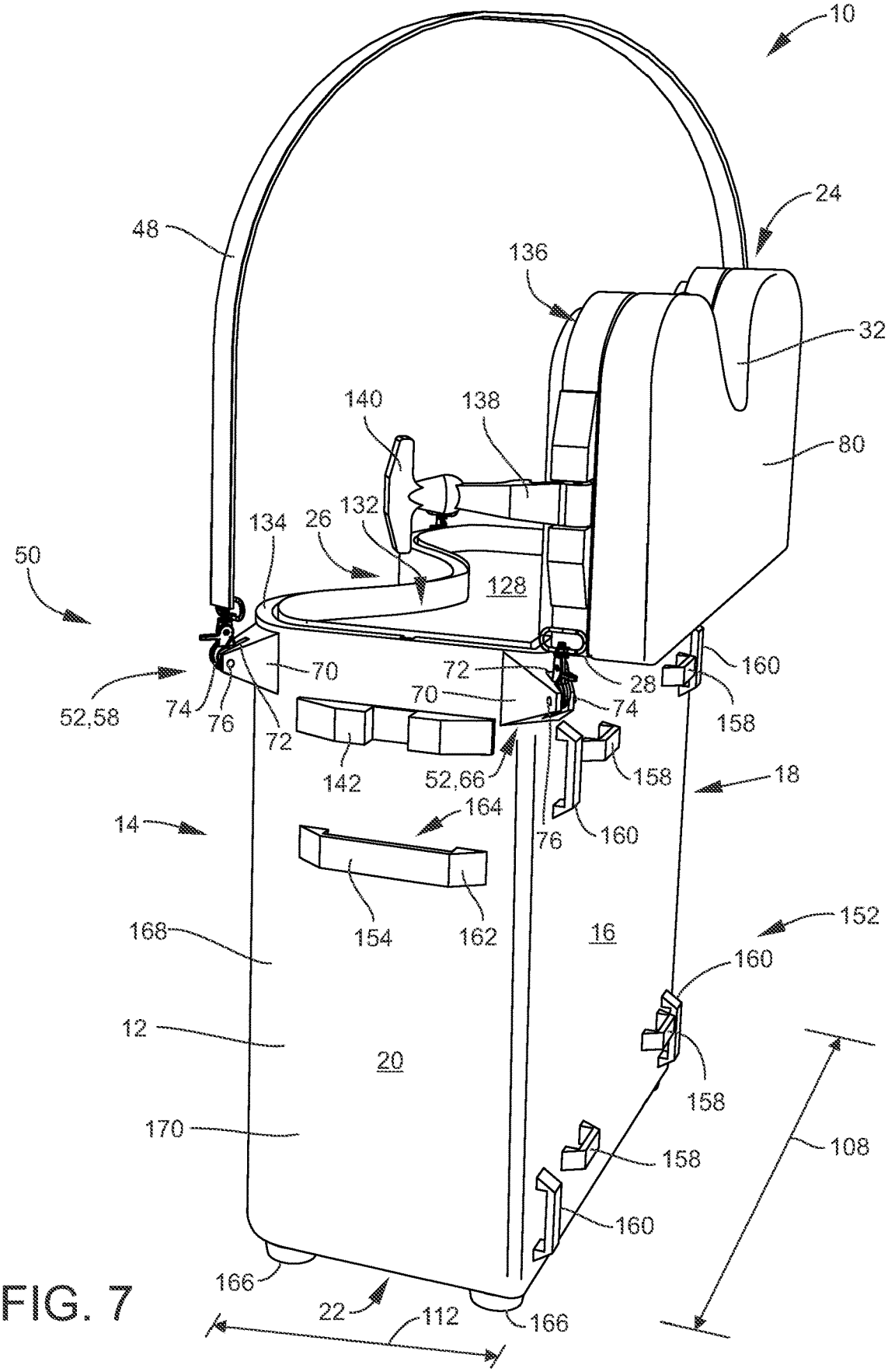
FIG. 7 is a side perspective view of the multi-purpose seat organizer of FIG. 1 with the hinged lid open showing the trey positioned at the elevated position in the interior of the sealed container body via the reduced height of the dividers.
Figure 8:
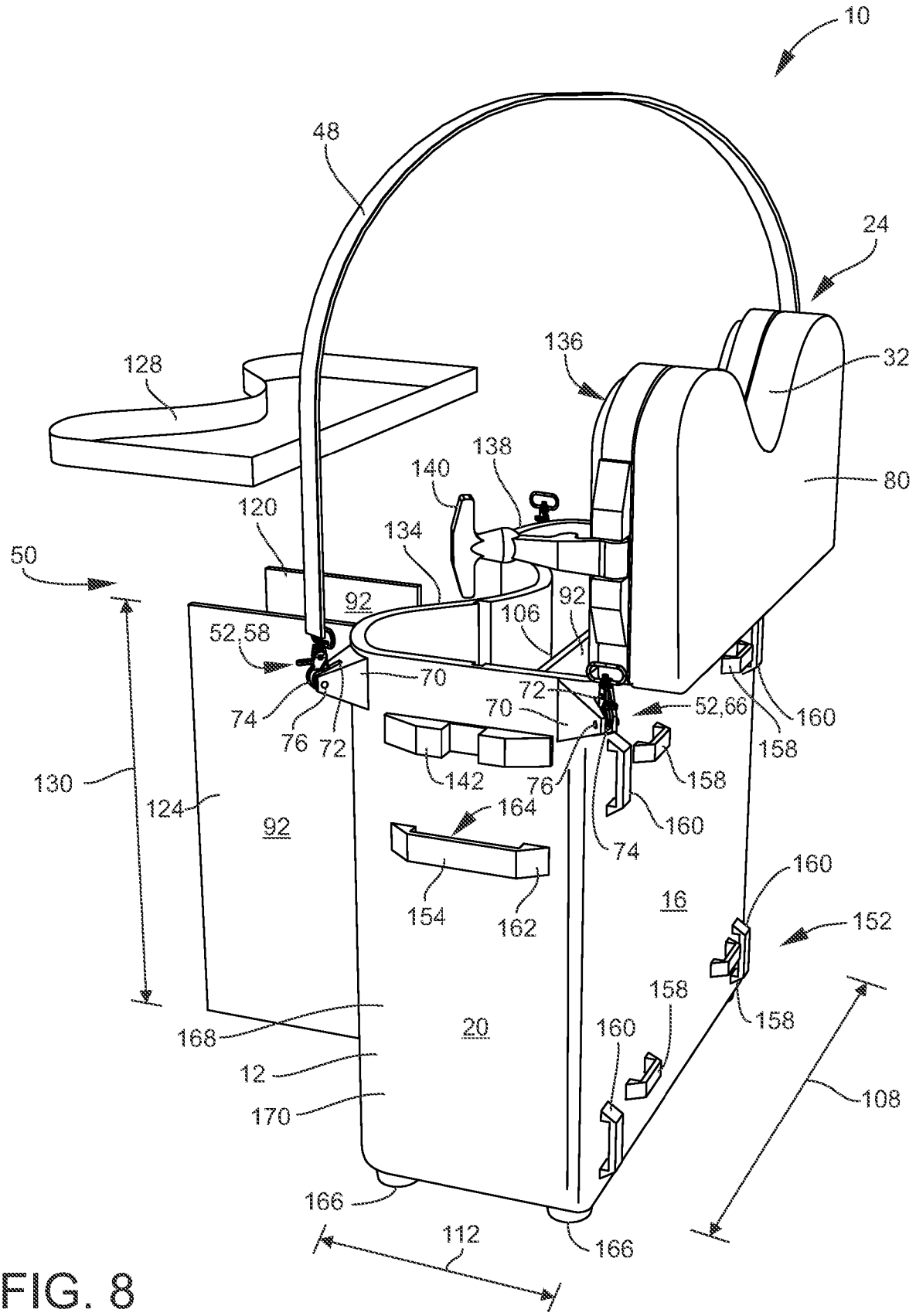
FIG. 8 is a partially disassembled perspective view of the multi-purpose seat organizer of FIG. 1 with the hinged lid open showing the length divider in the length channel with the trey and first and second width dividers removed.

Referring now to FIGS. 7 and 8, in select embodiments of multi-purpose seat organizer 10, trey 128 may be included. Trey 128 may be for providing a removable compartment at the top portion of interior 30 of sealed container body 12. Trey 128 may be configured and shaped to fit in interior 30 of sealed container body 12 including concave configuration 26 of front side 14. As such, trey 128 may have a concave configuration on one side configured to match concave front side 14. As shown in FIG. 8, in select embodiments, divider 92 or dividers 92 may include reduced height 130 configured to allow trey 128 to rest on divider 92 or multiple dividers 92 in interior 30 of sealed container body 12. This may position trey 128 on top of divider 92 or multiple dividers 92 at elevated position 132 approximate hinged lid 24. In other select embodiments, a lip, tabs, or protrusions may be included in the interior for supporting the trey in the interior of the sealed body container. This embodiment may be used with or without divider 92.

In order to make sealed container body 12 a sealed container, in select embodiments of multi-purpose seat organizer 10, hinged lid 24 may include gasket 136 configured to seal to top rim 134 of sealed container body 12. Or alternatively, top rim 134 of sealed container body 12 may include gasket 136 configured for sealing to hinged lid 24. Hinged lid 24 may include rubber pull down latches 138 with T-handles 140 on both side of hinged lid 24. Rubber pull down latches 138 with T-handles 140 may be configured to engage latch connection members 142 protruding from left side 18 and right side 20 of sealed container body 12. When hinged lid 24 is closed on sealed container body 12 and rubber pulldown latches 138 with T-handles 140 are engaged in latch connection members 142, hinged lid 24 may be sealed to top rim 134 of sealed container body 12 via gasket 136.

Referring now to FIG. 5, in select embodiments, another feature of multi-purpose seat organizer 10 may be the inclusion of waterproof storage pouch 144. Waterproof storage pouch 144 may be positioned on underside 146 of hinged lid 24. Waterproof storage pouch 144 may be for providing another organizational compartment in interior 30 of sealed container body 12 for providing a waterproof option for storage and organization.

Figure 9:
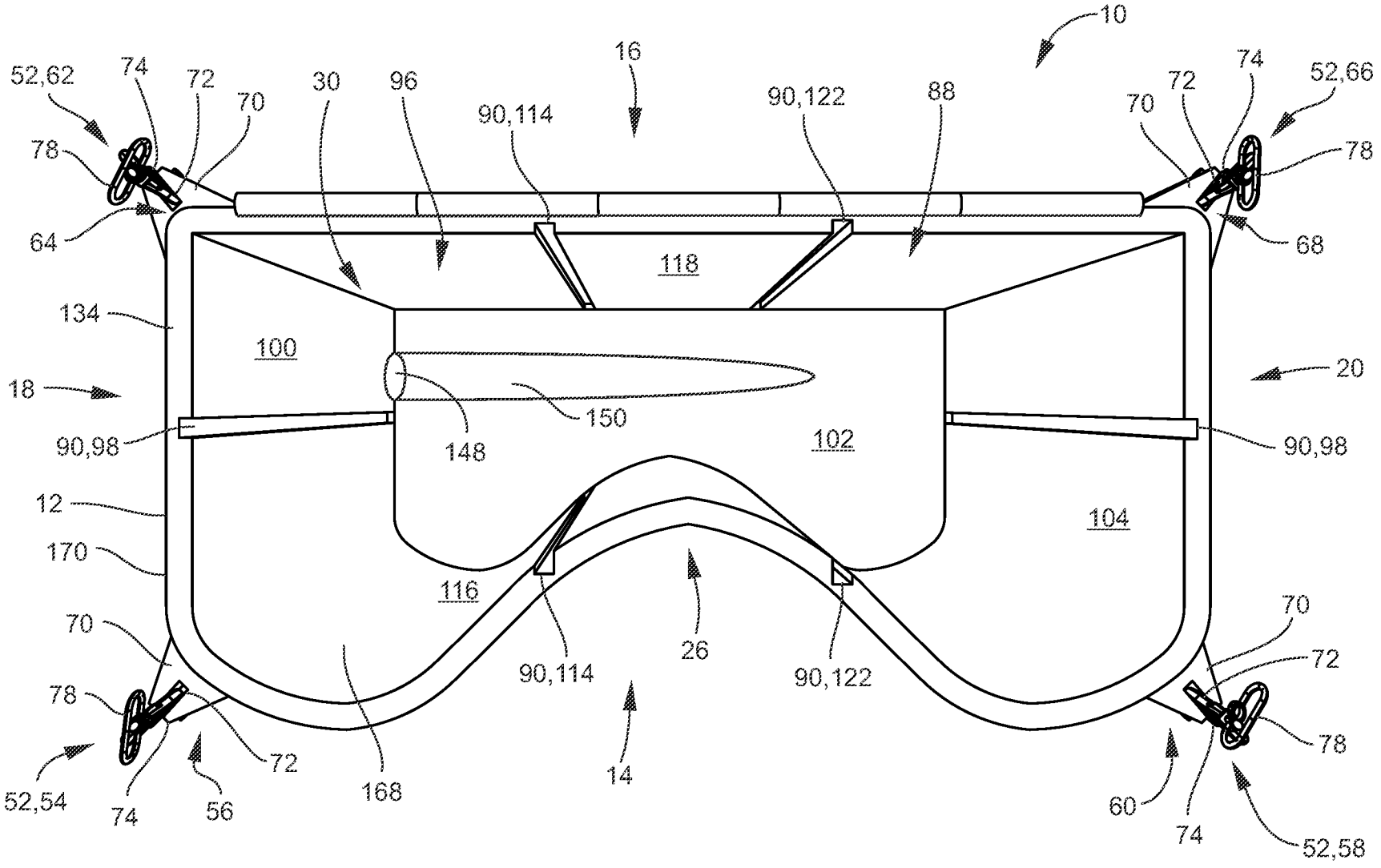
FIG. 9 is a top perspective view of a partially disassembled perspective view of the multi-purpose seat organizer of FIG. 1 with the hinged lid removed for showing the interior with the modular design and sloped bottom toward the drain plug.

Referring now to FIGS. 1, 2, 4, 5, and 9, another optional feature of select embodiments of multi-purpose seat organizer 10 may be the inclusion of drain plug 148. Drain plug 148 may be for providing a means for more draining sealed container body 12 without dumping it over. Drain plug 148 may be in one of the sides (left side 18 or right side 20) near bottom 22. In select embodiments, as shown in FIG. 9, interior 30 of sealed container body 12 may include sloped bottom portion 150 configured to allow for washout using drain plug 148. As such, sloped bottom portion 150 may be configured and shaped to slant or flow towards drain plug 148. Sloped bottom portion 150 and drain plug 148 may be off centered, whereby length channel 98 may be unobstructed by sloped bottom portion 150. As such, length divider 106 may seal to length channel 98.

Referring now to FIGS. 1-8, in select embodiments, another feature of multi-purpose seat organizer 10 may be the inclusion of at least one accessory connection unit 152. Accessory connection units 152 may be for attaching various accessories to the outside of multi-purpose seat organizer 10. For example, and clearly not limited thereto, accessory connection units 152 may allow for various outdoors, recreational, hunting, fishing, pool, beach, the like, etc. accessory items to be attached to the outside of multi-purpose seat organizer 10. As more specific examples, accessory connection units could be used for hanging/connecting other accessories, like if the seat is being used for hunting for example the user could have two shell pouches hung on first handle connection unit 154 or second handle connection unit 156 on either end of multi-purpose seat organizer 10. A similar type of pouch could be used if multipurpose seat organizer is being taken to the beach for someone to put sunscreen, drinks, etc. in. In addition, accessory connection units could allow the user to connect backpack straps, webbing, or the like, to allow for carrying of fly roads, mojo poles, umbrella's, etc. Accordingly, accessory connection unit 152 or units 152 may be configured for connecting accessories to multi-purpose seat organizer 10. In select embodiments, as shown in the Figures, the accessory connection unit 152 may include: first handle connection unit 154 on right side 20 and a second handle connection unit 156 on left side 18. These two accessory connections units 154 and 156 on the sides of the multi-purpose seat organizer 10 may be duel purposes, where they not only act as accessory connection units 152, but also as handles for carrying multi-purpose seat organizer 10. When these two accessory connections units, first handle connection unit 154 and second handle connection unit 156, are used to carry the multi-purpose seat organizer 10, concave configuration 26 of multi-purpose seat organizer 10 may move center of gravity 38 of multi-purpose seat organizer 10 closer to body 34 of user 36, thereby reducing forces and making the multi-purpose seat organizer 10 easier to handle and carry by a single person. As such, these two accessory connection units 152 may double as handles for carrying multi-purpose seat organizer 10 as well as being accessory connection units 152 for attaching or hanging various accessory items. In addition, on back side 16, four horizontal connection units 158 and four vertical connection units 160 may be included. The inclusion of horizontal connection units 158 and vertical connection units 160 may provide for various means, angles and configuration for attaching various and multiple accessory items. In select embodiments, as shown in the Figures, each accessory connection unit 152 may be molded protrusions 162 extending out from the walls of sealed container body 12 with attachment holes or slots 164 therethrough. In other embodiments, each accessory connection unit 152 may be cutouts built into the insulated walls 168 of sealed container body 12 with bars, hooks, or the like included in the cutouts for attaching any desired accessories.

As shown in the Figures, another feature of multi-purpose seat organizer 10 may be the inclusion of non-skid rubber feet 166. Non-skid rubber feet 166 may be on bottom 22 of sealed container body 12. Non-skid rubber feet 166 may be positioned approximate the corners (56, 60, 64 and 68) of bottom 22 of sealed container body 12. Non-skid rubber feet 166 may be rubber or other like materials on bottom 22 of sealed container body 12 configured for gripping the surface upon which multi-purpose seat organizer 10 is positioned.

Multi-purpose seat organizer 10 may be made from various materials as desired. In select possibly preferred embodiments, multi-purpose seat organizer 10 may include insulated walls 168. Insulated walls 168 of sealed container body 12 may be constructed out of any various materials for insulating interior 30 to the outside environment. As a result, insulated walls 168 may be configured to maintain temperatures inside multi-purpose seat organizer 10 and to reduce condensation on the exterior of multi-purpose seat organizer 10. As such, multi-purpose seat organizer 10 may be utilized for storing hot and/or cold items inside interior 30 of sealed container body 12. In select possibly preferred embodiments, insulated walls 168 may be made from non-porous plastic 170.

In sum, the present disclosure embraces a seat with a container, such as an organizer or cooler, that would have contoured front side 14 that would be designed to wrap around the user's body 34 while being carried. Multipurpose seat/container/organizer 10 may thus be designed to improve comfort when carrying and/or sitting above other seats, coolers and storage containers. It's unique concave design and four connection point system may allow the weight to be brought closer to the users' core when carrying, reducing stress on shoulders, arms and back. In addition, with its modular interior design 88, users can modify the internal space to fit their specific needs.

The Multipurpose Seat/Container/Organizer 10 may thus be designed first to be easier to handle and carry when loaded then any other item of similar size/capacity/design. With (4) strap connection points (54, 58, 62 and 66) the user can cross connect 50 the carrying shoulder strap 48 to help pull the load closer to the users' body 34. The concave configuration 26 then allows for the device to sit closer to the users' center of gravity, keeping the weight from pulling on the user. The Multipurpose Seat/Container/Organizer 10 may also utilize modular interior design 88 inside to allow the user to customize it to fit their specific needs. The Multipurpose Seat/Container/Organizer/Cooler 10 may be designed to be constructed out of non-porous plastic 170 with insulated walls 168. Insulated walls 168 are designed to keep temperatures steady (hot or cold) inside sealed container body 12 and to reduce condensation on the exterior of sealed container body 12 when used as a cooler. Insulated walls 168 may preferably be non-porous plastic 170 with channels 90 molded into the walls to allow for use of internal dividers 92 and the bottom 22 of interior 30 may include sloped bottom portion 150 to allow for easy washout using integrated drain plug 148.

The key advantage to Multipurpose Seat/Container/Organizer 10 may be its concave design and four connection point design. This design, as compared to current coolers, dove stools, sport seats, etc., may allow the load/weight to be brought closer to the user's center of gravity therefore limiting the amount of torque 40 and/or linear forces 42 placed on the body 34 of user 36.

The overall height 86 (height of product plus 2" removable cushion 80) of multi-purpose seat organizer 10 may be designed to be within the height guidance of the American's with Disabilities Act of 17-19". The concave design may also allow user 36 to bring their legs 44 and feet 46 more underneath them while sitting. Multi-purpose seat organizer 10 may be designed to be offered in many sizes which will change the overall height but not the concave design and its benefits to the user while seated. Multipurpose Seat/Container/Organizer 10 may also have several accessory connection units 152 molded into the exterior of sealed container body 12. Accessory connection units 152 may be provided on each end (left side 18 and right side 20) and on back side 16 of sealed container body 12 for attaching and/or hanging various accessory items to multi-purpose seat organizer 10.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A multi-purpose seat organizer comprising:

a sealed container body having a front side, a back side, a left side, a right side, a bottom and a hinged lid;

the front side has a concave configuration;

the hinged lid includes a back edge hingedly fixed to the back side for accessing an interior of the sealed container body;

the hinged lid includes a concave front edge configured to match the concave configuration of the front side;

the concave configuration of the front side and the concave front edge of the hinged lid are configured to wrap around a body of a user while being carried thereby positioning a center of gravity of the multi-purpose seat organizer closer to the user while being carried;

the hinged lid includes a left hinge side and a right hinge side perpendicularly oriented with the back edge hingedly fixed to the back side, the left hinge side and the right hinge side each including a rubber pull down latch with a T-handle, the rubber pull down latches with the T-handles are configured to engage latch connection members protruding from the left side and the right side of the sealed container body for sealing the hinged lid to the sealed container body on its left side and its right side perpendicular to the back side with the hinged lid;

a shoulder strap that is cross-connected to aid in positioning the center of gravity of the multi-purpose seat organizer closer to the user while being carried and to limit an amount of torque or linear forces placed on the body of the user;

strap connection points approximate the hinged lid including:

a first strap connection point at a first corner of the front side and the left side;

a second strap connection point at a second corner of the front side and the right side;

a third strap connection point at a third corner of the back side and the left side; and a fourth strap connection point at a fourth corner of the back side and the right side; and wherein, the shoulder strap is cross-connected between either:

the first strap connection point and the fourth strap connection point; or the second strap connection point and the third strap connection point;

wherein each of the strap connection points including:

a pyramid shaped protrusion with a cutout at a peak of the pyramid shaped protrusion;

a rod positioned through the cutout of the protrusion;

wherein, the shoulder strap that is cross-connected including removable clasps at each end configured to be inserted in the cutout of the pyramid shaped protrusion and removably attached to the rod;

a drain plug in one of the left side or the right side near the bottom, wherein the interior of the sealed container body including a sloped bottom portion configured to allow for washout using the drain plug, the drain plug and the sloped bottom being off center to allow for a length channel extending from an interior left wall through a bottom surface to an interior right wall, the length channel is configured to receive a length divider across a length of the interior of the sealed container body, whereby, when the length divider is inserted into the length channel, the length divider separates the interior into two width-wise compartments along a width of the multi-purpose seat organize, whereby the length channel is unobstructed by the sloped bottom portion, thereby allowing the length divider to seal to the length channel; and at least one accessory connection unit configured for connecting accessories to the multi-purpose seat organizer, the at least one accessory connection units including:

a first handle connection unit on the right side;

a second handle connection unit on the left side;

four horizontal connection units on the back side; and four vertical connection units on the back side;

wherein, each of the accessory connection units being molded protrusions extending out from the sealed container body with attachment holes or slots therethrough.

2. The multi-purpose seat organizer according to claim 1, wherein:

the concave configuration of the front side and the concave front edge of the hinged lid positioning the center of gravity of the multi-purpose seat organizer closer to the user while being carried is configured to limit an amount of torque or linear forces placed on the body of the user; and the concave configuration of the front side and the concave front edge of the hinged lid are also configured to allow the user to bring their legs and feet more underneath them while sitting on the hinged lid.

3. The multi-purpose seat organizer of claim 2, wherein the hinged lid including a cushion configured to be removably attached to the hinged lid via snaps, the cushion being shaped to conform to the hinged lid with the concave front edge, wherein the cushion having a thickness of 2 inches or approximately 2 inches, wherein an overall height of the multi-purpose seat organizer with the cushion is between 17 inches and 19 inches thereby conforming to disability guidelines.

4. The multi-purpose seat organizer according to claim 1, wherein the interior of the sealed container body having a modular interior design including at least one channel configured to receive a divider, whereby, when the divider is inserted into the at least one channel, the divider separates the interior into multiple compartments, wherein the at least one channel of the modular interior design is molded into interior walls to allow for use of the divider, where the divider is configured to seal to the at least one channel.

5. The multi-purpose seat organizer according to claim 4, wherein the modular interior design of the interior of the sealed container body including at least:

a first width channel extending from an interior front wall through a bottom surface to an interior rear wall, the first width channel is configured to receive a first width divider across a width of the interior of the sealed container body; and a second width channel extending from the interior front wall through the bottom surface to the interior rear wall, the second width channel is configured to receive a second width divider across the width of the interior of the sealed container body;

whereby, when the first width divider is inserted into the first width channel and the second width divider is inserted into the second width channel, the first width divider and the second width divider separate the interior into three length-wise compartments along a length of the multi-purpose seat organizer.

6. The multi-purpose seat organizer according to claim 4, wherein the modular interior design of the interior of the sealed container body consisting of:

a first width channel extending from an interior front wall through the bottom surface to an interior rear wall, the first width channel is configured to receive a first width divider across a width of the interior of the sealed container body; and a second width channel extending from the interior front wall through the bottom surface to the interior rear wall, the second width channel is configured to receive a second width divider across the width of the interior of the sealed container body;

whereby:

when the first width divider is inserted into the first width channel and the second width divider is inserted into the second width channel, the first width divider and the second width divider separate the interior into three length-wise compartments along the length of the multi-purpose seat organizer.

7. The multi-purpose seat organizer according to claim 4 further comprising a tray configured and shaped to fit in the interior of the sealed container body including the front side with the concave configuration, wherein, the divider including a reduced height configured to allow the trey to rest on the divider in the interior of the sealed container body at an elevated position approximate the hinged lid.

8. The multi-purpose seat organizer according to claim 1, wherein:

a top rim of the sealed container body including a gasket configured for sealing the top rim of the sealed container body to the hinged lid;

wherein, when the hinged lid is closed on the sealed container body and the rubber pulldown latches with the T-handles are engaged in the latch connection members, the hinged lid is sealed to the top rim of the sealed container body via the gasket.

9. The multi-purpose seat organizer according to claim 1 further including:

a waterproof storage pouch on an underside of the hinged.

10. The multi-purpose seat organizer according to claim 1 further including non-skid rubber feet on the bottom of the sealed container body, where the non-skid rubber feet are positioned approximate corners of the bottom of the sealed container body.

11. The multi-purpose seat organizer according to claim 1, wherein the sealed container body including insulated walls constructed out of non-porous plastic, wherein the insulated walls are configured to maintain temperatures inside the multi-purpose seat organizer and to reduce condensation on the exterior of the multi-purpose seat organizer.

* * * * *